United States Patent [19]

Forster et al.

[11] Patent Number: 4,681,235

[45] Date of Patent: Jul. 21, 1987

[54] ELASTIC ARTICULATION OF A CENTRAL BUFFER COUPLING FOR RAIL VEHICLES

[75] Inventors: Hilmar Forster, Wolfenbuttel; Harald Lindner, Salzgitter, both of Fed. Rep. of Germany

[73] Assignee: Scharfenbergkupplung GmbH, Fed. Rep. of Germany

[21] Appl. No.: 682,017

[22] Filed: Dec. 17, 1984

[30] Foreign Application Priority Data

Dec. 15, 1983 [DE] Fed. Rep. of Germany ..... 3345381
Jun. 7, 1984 [DE] Fed. Rep. of Germany ..... 3421166

[51] Int. Cl.[4] ..... B61G 9/06

[52] U.S. Cl. ..... 213/50; 213/40 R; 213/64; 213/221

[58] Field of Search ..... 213/7, 40 R, 40 D, 40 S, 213/50, 59, 62 R, 64, 220, 221; 293/136; 267/63 A

[56] References Cited

U.S. PATENT DOCUMENTS 2,203,542 6/1940 Page ..... 213/50 X
2,553,636 5/1951 Dath ..... 213/40 D
4,136,787 1/1979 Forster et al. ..... 213/40 R

FOREIGN PATENT DOCUMENTS 2701984 7/1978 Fed. Rep. of Germany .

*Primary Examiner*—Randolph A. Reese
*Attorney, Agent, or Firm*—McGlew and Tuttle

[57] ABSTRACT

To obtain a defined reset for horizontal articulations for an elastic articulation of a central buffer coupling, if at least one elastic ring is used, the inner part of the housing as well as the drawbar have the greater axis of their cross-section in the vertical in the installed position. The coupling which is secured on the vehicle and a drawbar which traverses the housing are supported by a ring of rubber, plastic or similar resilient material which is prestressed normal to the coupling axle of the coupling and arranged between the housing and the drawbar. The drawbar and a side of the housing have peripheral cams directed toward each other. The housing and the drawbar have an oval cross-section and the rings are spaced by cams formed on the drawbar and portions of the housing, the ring and the housing and the drawbar have a major axis of their cross-section extending along the vertical in their installed position.

1 Claim, 3 Drawing Figures

ELASTIC ARTICULATION OF A CENTRAL BUFFER COUPLING FOR RAIL VEHICLES

FIELD AND BACKGROUND OF THE INVENTION

This invention relates in general to rail vehicles and in particular to a new and useful central buffer coupling for rail vehicles.

The invention relates to an elastic articulation of a central buffer coupling for rail vehicles, with a housing secured on the vehicle and with a drawbar traversing the housing at equal spacing, where rings of rubber or plastic prestressed normal to the coupled axle are arranged between the housing and the drawbar and the drawbar as well as the inside of the housing have peripheral cams directed toward each other, and where the housing and the drawbar have an oval cross-section and the rings are held spaced by the cams.

In German OS No. 27 01 984, referring to an elastic articulation, the horizontal swivel movements of the drawbar are made possible by the articulation of the housing through vertical pins on the vehicle, while vertical swivel movements and the rotational movements about the coupled axle are made possible by the elastic suspension of the drawbar with defined reset. This elastic articulation using several elastic rings has proved fully satisfactory under operating conditions in their area of use for heavy rail vehicles. In the case of lighter and smaller rail vehicles, as a rule, neither the depth needed for the installation nor the height needed for the pin suspension exists. In consideration of the existing installation height, therefore, the housing was secured on the vehicle, and in order to reduce the installation depth the spring support was reduced to one ring. It was found that the occurring tensile and compressive forces are indeed absorbed by one ring, but by moving the major cross-section of the pull rod into the horizontal plane, a horizontal reset is no longer provided.

SUMMARY OF THE INVENTION

The invention provides an elastic articulation of a construction such that for a small structural size of the elastic articulation with a fixed housing, a defined horizontal reset is made possible, the reset being always provided both for vertical swivel movements and for rotation movements about the coupled axle.

According to the invention, when using at least one ring, the inner part of the housing as well as the drawbar have the major axis of their cross-section in the vertical in the installed position.

Accordingly an object of the invention is to provide an elastic articulation of a central buffer coupling for rail vehicles which comprises a housing which is adapted to be secured to the vehicle and a drawbar which traverses the housing and is supported on at least one ring of a resilient material prestressed normal to the axle of the coupling and arranged between the housing and the drawbar. The drawbar in the housing has peripheral cams directed toward each other and they are of oval cross-section, the ring being held in a central position by the cams between the housing and the coupling in a vertical axis.

A further object of the invention is to provide a coupling which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

SUMMARY OF THE INVENTION

DESCRIPTION OF THE PREFERRED EMBODIMENT

Figure 1:
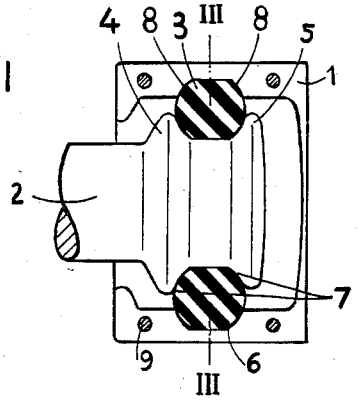
FIG. 1 is a longitudinal sectional view of a rail vehicle control buffer shown in unstressed position and constructed in accordance with the invention.

Referring to the drawings in particular the invention embodied therein comprises an elastic articulation of a central buffer coupling for rail vehicles which includes a housing portion 1 fixed thereto having an opening at one side of a socket into which a drawbar head is positioned and supported by a ring of a resilient material. The ring of resilient material is held by cams defined at spaced axial locations on the drawbar and at spaced locations on the housing which abut respective sides of the ring and hold it a substantially vertical position.

The housing 1 is secured on a rail vehicle (not shown) and embraces a drawbar 2 connected with a coupler head. The drawbar 2, as well as the inner part of housing 1 have an oval cross-section which, in the installed position, has a major axis in the vertical. When using an elastic ring 3, the drawbar 2 is provided with peripheral cams 4 and 5, while the housing 1 has on its interior a groove 6 opposite the section of the drawbar 2 limited by the cams 4 and 5. The shoulder 7 of the peripheral cams 4,5 and the shoulder 8 of groove 6 are at an angle to the vertical axis of housing 1. The drawbar 2 is held at the predetermined spacing from housing 1 by a ring 3 of rubber or plastic arranged normal to the coupled axle and inserted with prestress between the shoulder 6 and 7, and to facilitate assembly and to make the prestress adjustable, the housing 1 comprises two half-shells to be releasably joined in mirror symmetry by means of bolts 9, the ring 3 being split on one or both sides.

Figure 2:
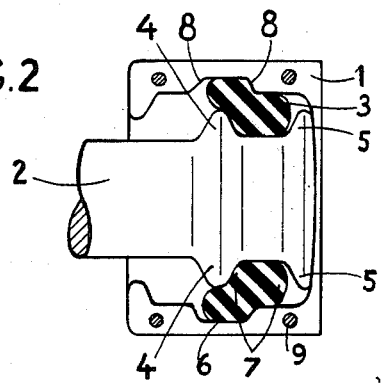
FIG. 2 is a view similar to FIG. 1 but in pressurized position.
Figure 3:
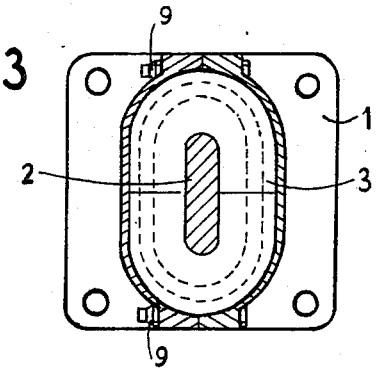
FIG. 3 shows a section taken along line III-III of FIG. 1.

Now if, indicated for example in FIG. 2, the drawbar 2 is pressurized, ring 3 rolls off in accordance with the roll-off contour predetermined by the formation of the shoulder and according to the given prestress, thus absorbing the impacts elastically. With increasing load in axial direction the ring becomes elastically deformed additionally, whereby a progressive spring characteristic is provided. Under tensile stress the arrangement reacts analogously. Swivel movements of the coupling in vertical or horizontal direction are elastically absorbed by deformation of ring 3. By selection of the oval cross-section of the drawbar 2 and of the inner part of housing 1 different restoring forces result for swivel movements of the drawbar from the axial neutral position. The greater restoring forces and hence also a greater stiffness of the arrangement result in a deflection in the plane of the greater axis. In order to obtain over the entire necessary horizontal swivel range of the coupling on both sides an elastic deformation with progressive characteristic and a defined reset, the plane with the minor axis of the cross-section is placed horizontally. Vertical coupling movements and also the rotational movements about the coupled axle and their defined reset are always provided with this arrangement under the operating conditions.

For use in heavy rail vehicles with existing installation depth, this elastic articulation with fixed housing may also be realized with more than one ring 3, in which case the number of cams 4,5 and of the groove 6 must be increased accordingly.

While a specific embodiment of the invention has been shown and described in detail to illustrate the application of the principles of the invention, it will be understood that the invention may be embodied otherwise without departing from such principles.

What is claimed is:

1. An elastic articulation of a central buffer coupling for rail vehicles, comprising a housing adapted to be secured on the vehicle, a drawbar traversing said housing, at least one oval ring of resilient material prestressed normal to the axis of said coupling arranged between said housing and said drawbar, said drawbar as well as the inside of said housing having peripheral cams directed toward each other, said housing and said drawbar having oval crosssections with their axes disposed vertically, said rings being held spaced by said cams, and wherein said housing, said ring as well as said drawbar have a major axis of their cross-section disposed in the vertical in their installed position.

* * * * *